US008091519B2

(12) United States Patent
Bennion

(10) Patent No.: US 8,091,519 B2
(45) Date of Patent: Jan. 10, 2012

(54) PAIRED-PISTON LINEAR ENGINE

(76) Inventor: Robert F. Bennion, West Jordan, UT (US)

( * ) Notice: Subject to any disclaimer, the term of this patent is extended or adjusted under 35 U.S.C. 154(b) by 830 days.

(21) Appl. No.: 11/747,212

(22) Filed: May 10, 2007

(65) Prior Publication Data

US 2007/0261677 A1 Nov. 15, 2007

Related U.S. Application Data

(60) Provisional application No. 60/747,147, filed on May 12, 2006.

(51) Int. Cl.
*F02B 71/04* (2006.01)

(52) U.S. Cl. ..... 123/51 R

(58) Field of Classification Search ..... 123/46 R–46 H, 123/51 AA, 64, 51; 307/73
See application file for complete search history.

(56) References Cited

U.S. PATENT DOCUMENTS 1,722,425 A 7/1929 Junkers
1,788,140 A * 1/1931 Woolson ..... 123/51 AA
1,808,083 A * 6/1931 Tibbetts ..... 123/64
2,078,157 A 4/1937 Pescara
4,996,953 A * 3/1991 Buck ..... 123/51 A
2005/0109295 A1 * 5/2005 Kaneko et al. ..... 123/46 E
2009/0031724 A1 * 2/2009 Ruiz ..... 60/618
2009/0108676 A1 * 4/2009 Algrain ..... 307/73
2009/0139740 A1 * 6/2009 Lindsey et al. ..... 174/50.5

* cited by examiner

*Primary Examiner* — M. McMahon
(74) *Attorney, Agent, or Firm* — Utah Valley Patent; Steve McDaniel

(57) ABSTRACT

A linear internal combustion engine is disclosed having a cylinder defining an intake port proximate a first end thereof and an exhaust port proximate a second end thereof. First and second pistons insert into opposite ends of the cylinder. Each piston is coupled to an actuator/generator, such as a linear switched reluctance motor. The actuator/generators are coupled to a control unit which controls the actuator/generators and extracts energy therefrom. The control unit causes the actuators to move the pistons through a fluid handling process, such as pumping, compression, or a four cycle combustion process coupled with a recovery phase. The pistons are positioned over the intake and output ports to seal them off at proper times during the fluid handling process.

15 Claims, 12 Drawing Sheets

PAIRED-PISTON LINEAR ENGINE

RELATED APPLICATIONS

This application claims priority to U.S. Provisional Application No. 60/747,147 entitled "PAIR-PISTON LINEAR ENGINE" and filed on 12 May 2006 for Robert F. Bennion and Steven F. McDaniel which application is incorporated herein by reference.

BACKGROUND OF THE INVENTION

1. Field of the Invention

This invention relates generally to internal combustion engines and more particularly to linear internal combustion engines.

2. Description of the Related Art

The vast majority of internal combustion engines currently in use are reciprocating engines in which a piston moves up and down within a cylinder. The linear motion of the piston is translated into rotary motion by a crankshaft connected to the piston by a piston rod. In a typical engine, due to the large forces involved, the coupling between the crankshaft and the piston rod and between the piston and the piston rod, is a simple journal bearing. Accordingly, significant friction is introduced when converting the reciprocating motion of the piston to rotary motion.

Current internal combustion engines further require complicated valving mechanisms in order to introduce fuel and air into the cylinder and to release exhaust gases. Typically such mechanisms involve spring loaded valves that are biased toward the closed position. Cams, driven by the crankshaft open and close the valves at appropriate times by pushing against valve stems attached to the valves. The contact between the cam and the valve stems is typically a sliding contact introducing a great deal of friction just to open the valve.

Free piston engines reduce mechanical complexity and losses resulting from the conversion of reciprocating motion to rotary motion by extracting energy from the reciprocating movement of one or more pistons free to move within a cylinder. However, free pistons are difficult to control in order to execute a multiple-phase combustion process. Furthermore, currently available systems typically require complicated valving mechanisms similar to those in traditional internal combustion engines. Accordingly, such systems have been cumbersome and unfeasible at small scales.

Accordingly, it would be an advancement in the art to provide a linear engine capable of extracting energy from a combustion process without requiring conversion of linear motion into rotary motion. It would be a further advancement in the art to provide such a system that eliminates the need for complicating valving or control mechanisms. Such a system would be scalable for use in both high power and low power applications.

SUMMARY OF THE INVENTION

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

In one embodiment of the invention, a cylinder is provided having an exhaust port formed in the wall toward a first end and an intake port formed in the wall toward a second end. A first and second piston are placed into opposite ends of the cylinder and move therealong during a fluid handling process. During execution of the fluid handling processes, the pistons are moved over the intake and exhaust ports, sealing them off at appropriate times. Thus, the need for complicated valving mechanisms is eliminated.

The first and second pistons may each be coupled to an actuator, which actuators cause the movement of the piston. The actuators may be electrically connected to a control unit which controls the movement of the actuators and causes them to perform a fluid handling process, such as a pumping process, a compression process, or a four stroke combustion process with a recovery phase (referred to herein as a five-phase combustion cycle).

In some embodiments, the first and second pistons are likewise coupled to generators, such that forced linear movement of the pistons during the combustion process generates electrical power. The generators and actuators may be separate units or may be an integrated device capable of performing both functions. In one embodiment, the functions of generator and actuator are performed by a linear switched reluctance motor. The linear switched reluctance motor is capable of converting the linear motion of the pistons into electrical power, thereby eliminating the need to convert the linear motion of the pistons to rotary motion.

The features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

Figure 1:
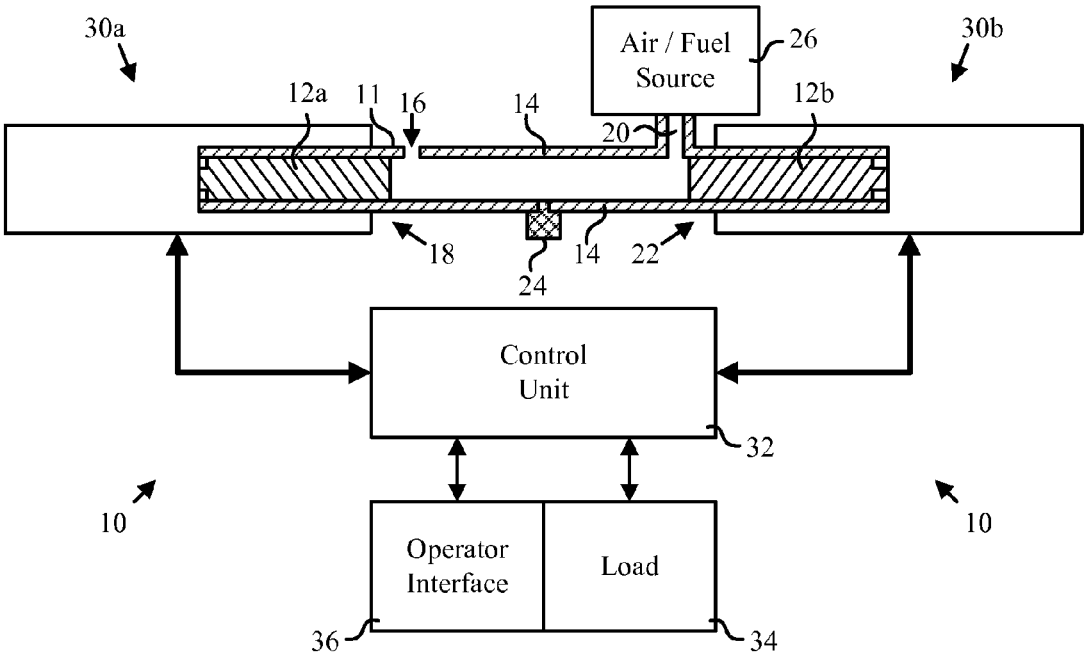
FIG. 1 is a side cross-section view of a linear engine, in accordance with the present invention.
Figure 2:
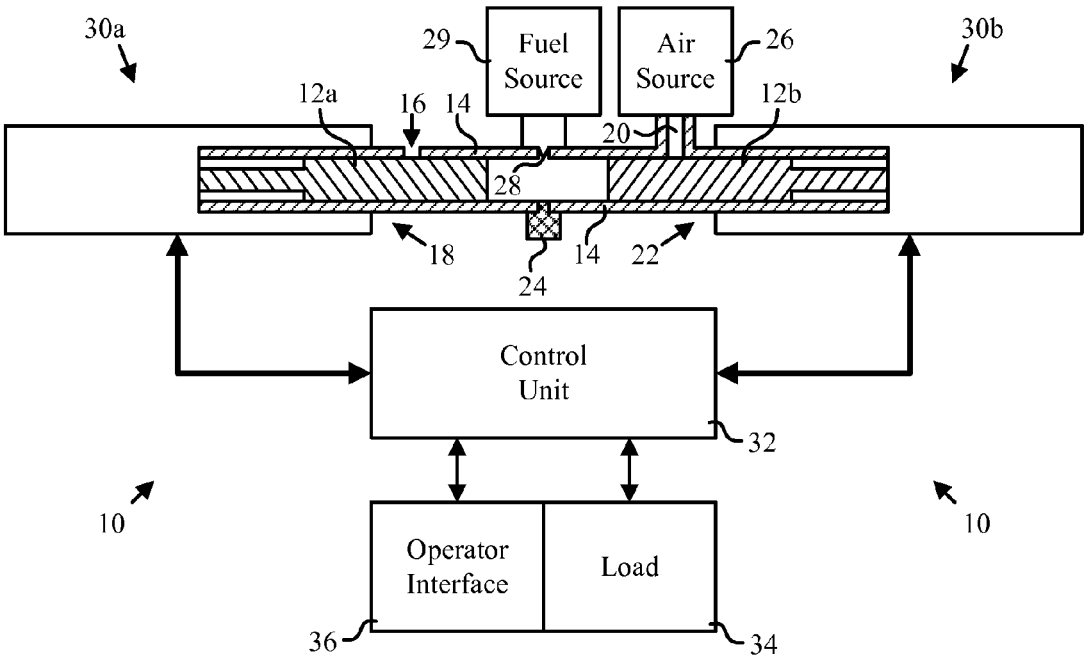
FIG. 2 is a side cross-section view of a linear engine having fuel injection, in accordance with the present invention.

Referring to FIGS. 1 and 2, an engine 10 may include two pistons 12*a*, 12*b* positioned within a cylinder 14. The pistons 12*a*, 12*b* may be sized to slide within the cylinder 14 while providing a substantial seal against the flow of gases between the cylinder 14 and the pistons 12*a*, 12*b*. The cylinder 14 may have an exhaust port 16 formed near a proximal end 18 and an intake port 20 near a distal end 22. An igniting device 24 may introduce a spark, or other source of heat, into the cylinder to ignite a fuel/air mixture within the cylinder 14. The igniting device 24 may be embodied as a spark plug, glow plug, or like device.

The intake port 20 may be in fluid communication with a source of an intake fluid, such as an air source 26 or air/fuel source 26. The air-fuel source 26 may be a fuel injection system controlled to inject gas into an air stream as air flows into the cylinder 14. Alternatively, the air/fuel source 26 may be a carburetor. In some embodiments, air and fuel are mixed by the air-fuel source 26 into a homogeneous charge that is ignited by compression ignition within cylinder 14. Referring to FIG. 2, in some embodiments an air source 26 may be used in combination with a fuel injector 28 and separate fuel source 29 for injecting fuel directly into the cylinder 14 such as required by a diesel cycle.

The intake port 20 and exhaust port 16 may be sealed by the pistons 12*a*, 12*b*. Thus, to seal the exhaust port 16 and intake port 20 during the combustion stroke, the pistons 12*a*, 12*b*, respectively, need only be positioned thereover. Accordingly, no complex valving or timing mechanisms are required with their attendant friction loads.

The pistons 12*a*, 12*b* may drive, and be driven by, actuator/generators 30*a*, 30*b*, respectively. The actuator/generators 30*a*, 30*b* may be powered to move the pistons 12*a*, 12*b* through movements necessary to accomplish a fluid handling process, such as the Otto cycle, Diesel cycle, or pumping process. The actuator/generators 30 may also convert linear kinetic energy of the pistons into electrical current. In some embodiments, the actuator/generators 30*a*, 30*b* may be replaced by actuators, or be used only as actuators, in order to accomplish a pumping process.

A control unit 32 may be electrically coupled to the actuator/generators 30*a*, 30*b* to control them, to draw electrical current therefrom, or both. A load 34 such as a battery, motor, electronic device, or the like may electrically couple to the control unit 32 to be powered by electrical energy extracted from the alternator/generators 30*a*, 30*b*. An operator interface 36 may provide an interface with an operator to set parameters of the control unit 34, such as the operating speed, fuel intake, air intake, and like parameters. The load may also function as an energy source during specific phases of the fluid handling process.

Referring to FIGS. 3A-3H, a control unit 32 may be programmed to cause the pistons 12*a*, 12*b* to execute a 5-phase combustion process. The 5-phase combustion process may be a mediated four-stroke combustion process and include a recovery phase to position the pistons 12*a*, 12*b* ready for the next iteration of the process.

Figure 3A:
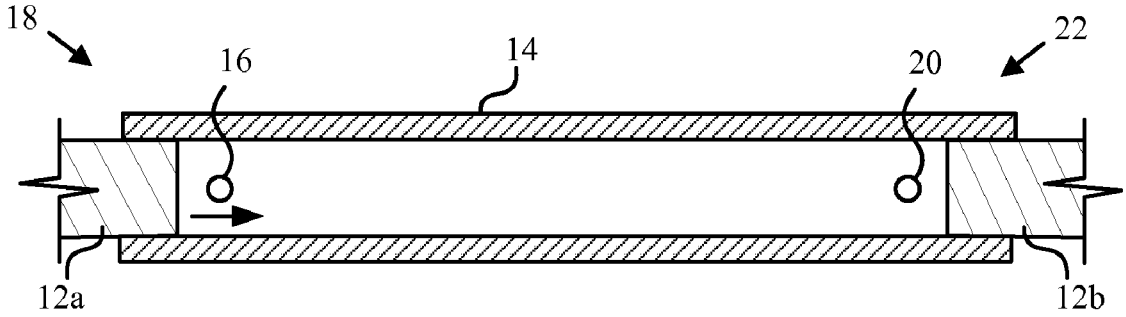
FIG. 3A-3H are schematic cross-sectional views illustrating the progression of the linear engine through a five-phase combustion process, in accordance with the present invention.
Figure 3B:
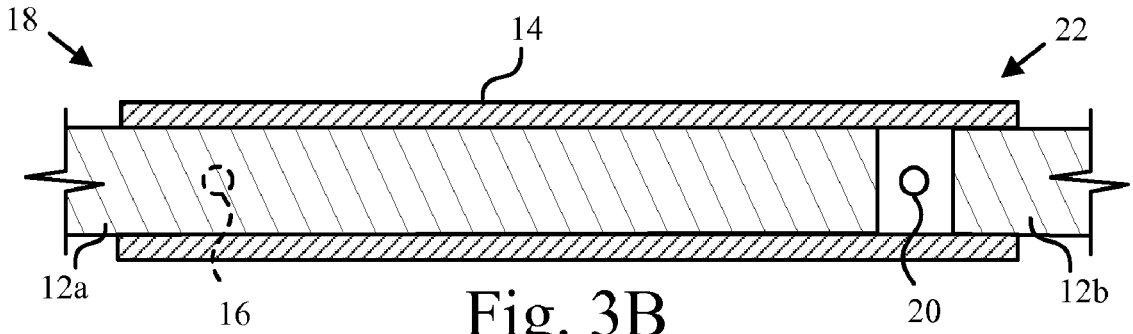
Figure 3C:
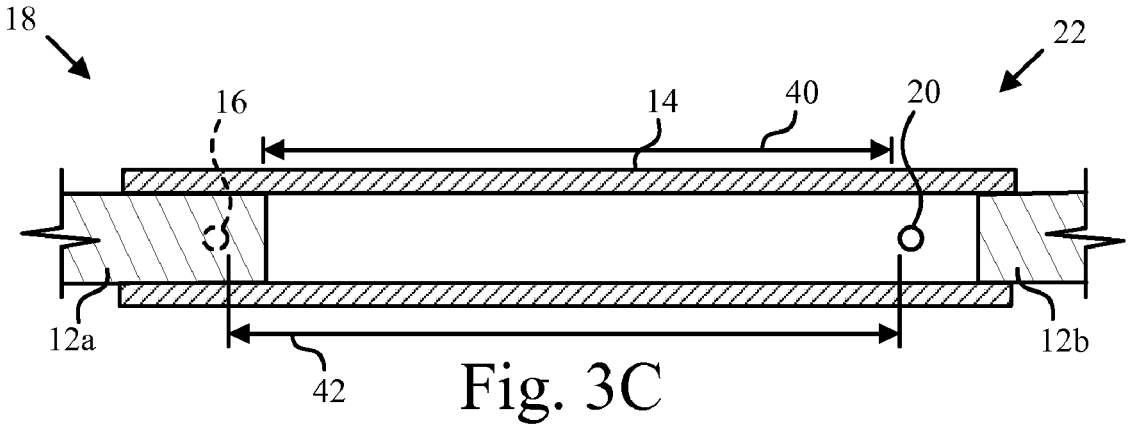

Referring to 3A, prior to ignition, the pistons 12*a*, 12*b* may begin in the positions illustrated, positioned at the proximal end 18 and the distal end 22, respectively. Referring to FIG. 3B, the actuator/generator 30*a* may move the piston 12*a* toward the distal end 22 such that the piston 12*a* moves to a position near or past the intake port 20, effectively vacating the cylinder 14 in preparation for an intake phase. Referring to FIG. 3C, the actuator/generator 30*b* may effect the intake phase by moving the piston 12*a* distance 40 toward the proximal end 18 such that the entire piston 12*a* does not entirely pass the exhaust port 16, effectively sealing against the release of gasses through the exhaust port 16. The distance 40 traveled by the piston 12*a* during the intake phase depicted in FIG. 3C is the intake distance 40. The length of the intake distance may 40 be varied to control the efficiency of the engine.

For example, during the combustion process, the pressure and volume of gas within the cylinder 14 increases. Accordingly, in order for the post-combustion contents of the cylinder 14 to expand until they reach atmospheric pressure, the combustion chamber must expand to a volume significantly larger than the volume of the air going into the combustion process. In a conventional engine, because the cylinder has a fixed size, combustion gases cannot expand further and perform more useful work. Accordingly, exhaust gases are simply released and the potential work is wasted.

In the apparatus 10, the intake distance 40 may be controlled by the actuator/generator 30*a* such that the distance 40 is less than the distance 42 between the intake port 16 and exhaust port 20, which is the approximate point of maximum volume of the combustion chamber formed by the pistons 12*a*, 12*b* and the cylinder 14. Accordingly, post-combustion contents of the cylinder 14 can hyper-expand beyond their original volume.

Figure 3D:
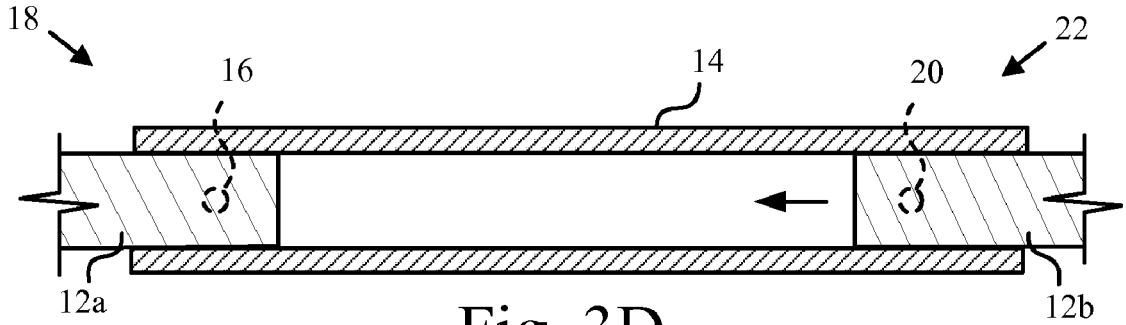
Figure 3E:
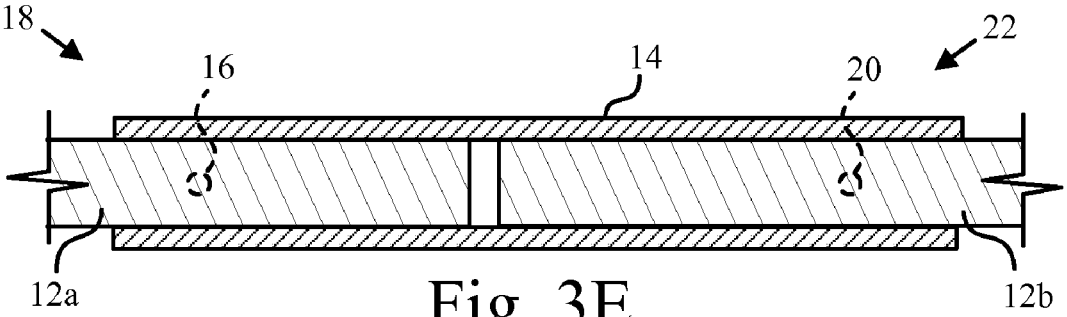

Referring to FIG. 3D, the piston 12*b* may then be moved toward the proximal end 18 such that it seals off the intake port 20. Referring to FIG. 3E, the compression phase may be accomplished by causing the piston 12*b* to continue moving toward the proximal end 18 as the piston 12*a* moves toward the distal end 22 until the pistons 12*a*, 12*b* have compressed the gases therebetween sufficiently to accomplish a given combustion process. In embodiments of the apparatus 10 executing a Diesel cycle, fuel is injected at this point. In embodiments of the apparatus 10 executing an Otto cycle, a spark is produced to ignite the air-fuel mixture. In some embodiments, the fuel air mixture may be compressed such that the temperature thereof increases enough to cause auto-ignition (i.e. compression ignition) without the need for a spark. For Diesel apparatus, the fuel ignites upon contact with the compressed air, although a glow plug may also serve to increase the temperature. In some iterations of the process of FIGS. 3A-3H, a combustionless expansion phase may replace the combustion phase. To accomplish a combustionless expansion phase, the compressed gas is simply heated by residual thermal energy stored in the wall of the cylinder 14 and the pistons 12*a*, 12*b*, rather than by combustion of fuel.

Figure 3F:
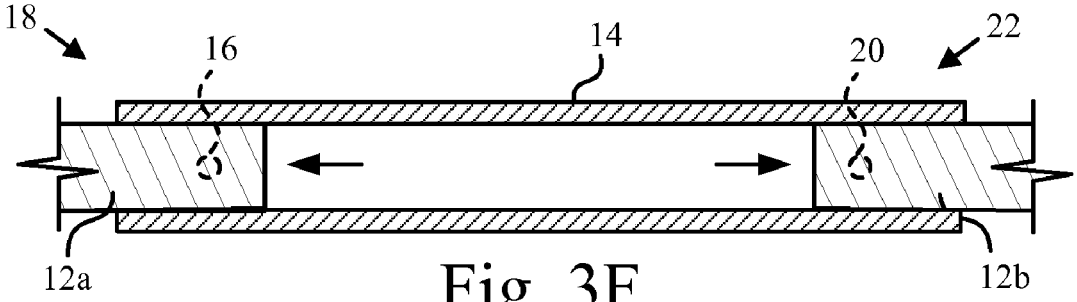

Referring to FIG. 3F, after ignition or injection, the fuel burns and expands to effect the combustion phase, driving the piston 12*a* toward the proximal end 18 and driving the piston 12*b* toward the distal end 22. During the phase of FIG. 3F, the actuator/generators 30*a*, 30*b* extract electrical energy from the movement of the pistons 12*a*, 12*b*, such as by moving a magnet across a coil, or like process.

Figure 3G:
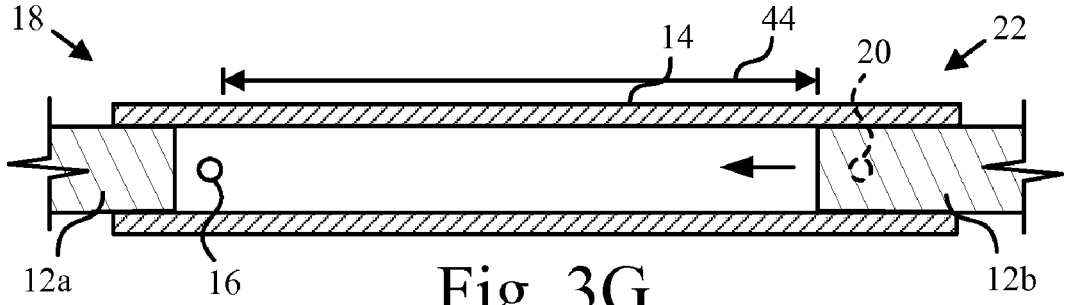

Referring to FIG. 3G, during the expansion phase the piston 12*b* may be moved to a position slightly proximal of the intake port 22, such that the intake port 22 remains sealed, whereas the piston 12*a* is moved to a position past the exhaust port 16. The distance 44 between the piston 12*b* and the exhaust port 16 represents the maximum volume of the combustion gases. Where the intake distance 40 is less than the distance 44, hyper-expansion is achieved.

Figure 3H:
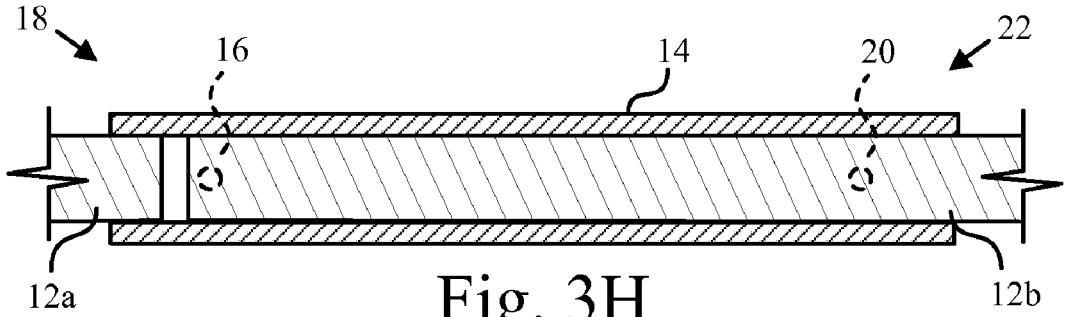

Referring to FIG. 3H, during the exhaust phase, the actuator/generator 30*b* may move the piston 12*b* toward the proximal end 18 such that the combustion gases are driven out through the exhaust port 16. Referring again to FIG. 3B, during the recovery phase, the pistons 12*a*, 12*b* may move toward the distal end 22 in preparation for the next iteration of the process.

Figure 4A:
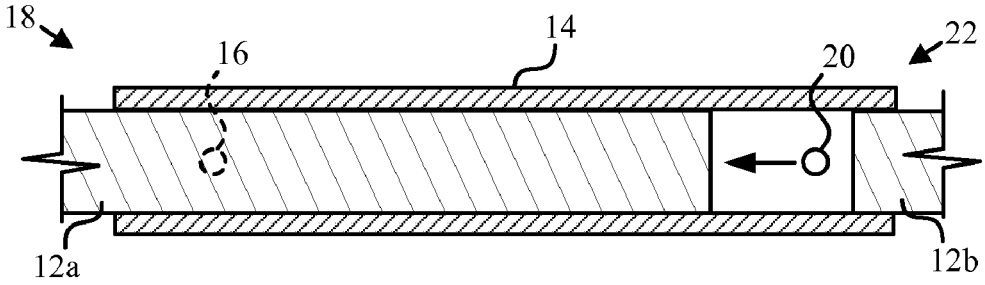
FIGS. 4A-4D are side schematic views illustrating the progression of the linear engine through a cooling process, in accordance with the present invention.
Figure 4B:
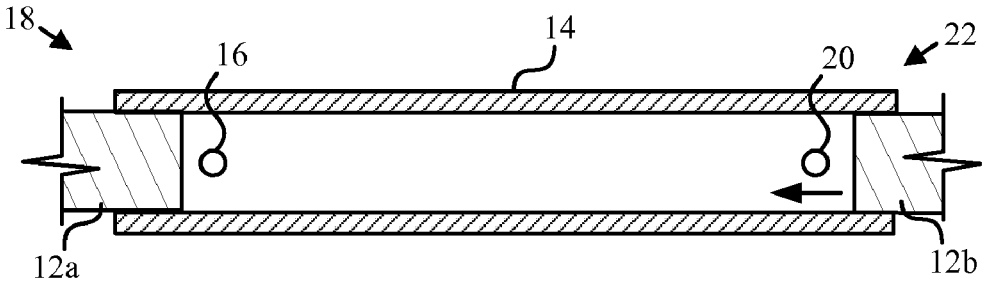
Figure 4C:
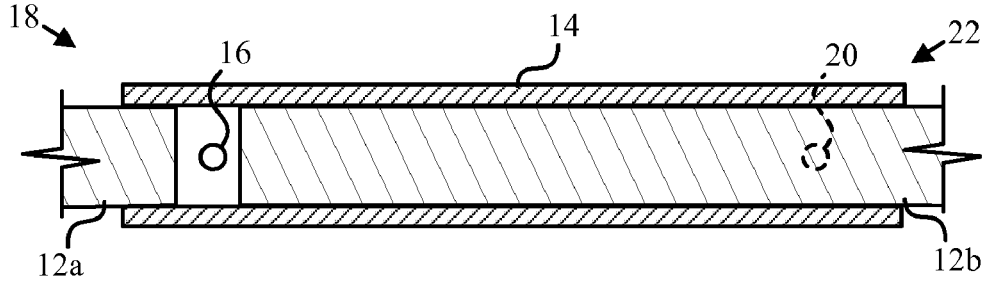
Figure 4D:
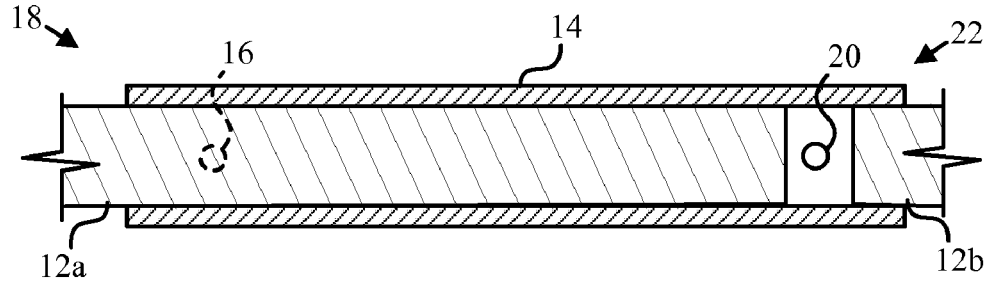

Referring to FIGS. 4A-4D, between iterations of the combustion process a cooling process may be executed to cool the pistons 12*a*, 12*b* and cylinder 14. Referring to FIG. 4A, the piston 12*a* may be moved from the position of FIG. 4A toward the distal end 18 past the exhaust port 16 into the position shown in FIG. 4B in order to draw cool air into the cylinder 14. The piston 12*b* may subsequently be moved toward the distal end 18 to the position of FIG. 4C, driving the air within the cylinder 14 out of the exhaust port 16. Referring to FIG. 4D, the pistons 12*a*, 12*b* may be moved toward the proximal end 22 in preparation for the next cooling process or combustion process. Multiple iterations of the cooling process of FIGS. 4A-4D may be performed based on the temperature of the engine. In some embodiments a temperature sensor may be read to determine when and how many times to perform the cooling process.

Figure 5A:
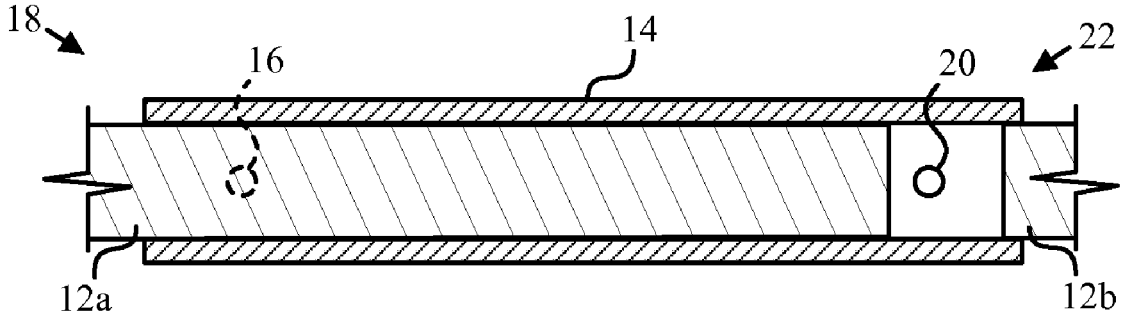
FIGS. 5A-5E are side schematic views illustrating the progression of the linear engine through a pumping process, in accordance with the present invention.
Figure 5B:
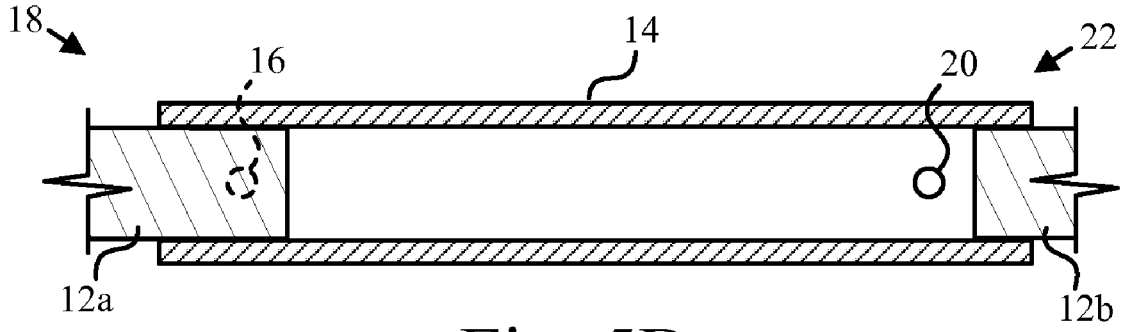
Figure 5C:
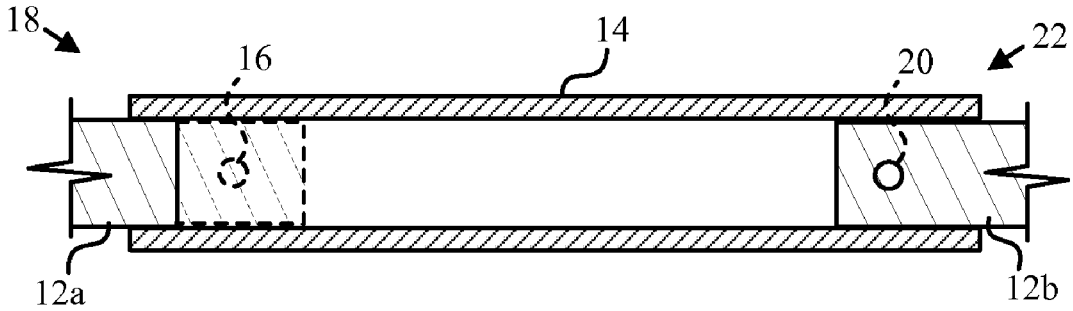

Referring to FIGS. 5A-5E, the apparatus 10 may be used to perform a pumping or compression process. Referring specifically to FIG. 5A, the pistons 12*a*, 12*b* may begin in the positions shown, with the piston 12*b* positioned between the distal end 22 and the intake port 20 and the piston 12*a* positioned near or over the intake port 20. Referring to FIG. 5B, the actuator/generator 30*a* may move the piston 12*a* toward the proximal end 18, drawing air or fluid into the cylinder 14. Referring to FIG. 5C, as the piston 12*a* approaches the exhaust port 16, the piston 12*b* may move to cover the intake port 20, such that pressurized fluid or air does not leak back into the cylinder 14 through the exhaust port 16 and out the intake port 20. In some embodiments, the apparatus 10 may pump electrically conductive fluids, such as between cells of an electrolytic battery, and therefore covering the intake port 20 before uncovering the exhaust port 16 inhibits creation of a conductive path from the intake port to the exhaust port 16.

In instances where the apparatus 10 is operating as a pump, the piston 12*a* may move expose the exhaust port 16 substantially immediately after, or simultaneous with, the sealing of the intake port 20 from the cylinder by the piston 12*a*. In instances where the apparatus 10 is operating as a compressor, the piston 12*a*, remains positioned over the exhaust port 16, as shown by the dotted representation of the piston 12*a* in FIG. 5C.

Figure 5D:
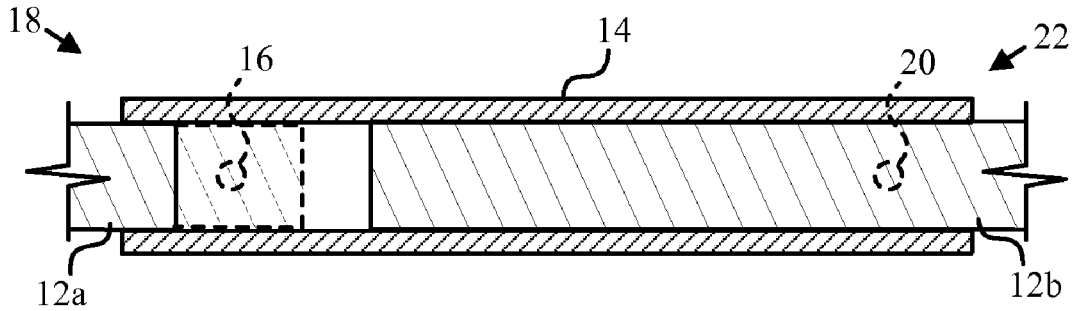
Figure 5E:
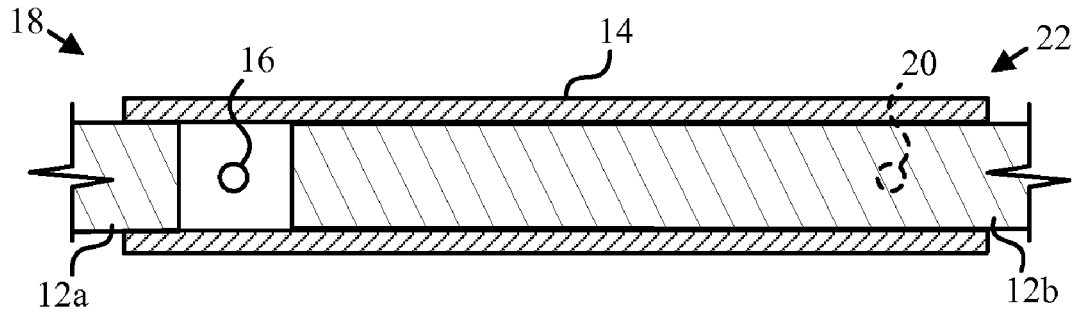

Referring to FIG. 5D, the piston 12*b* may continue to move toward the proximal end 18, either driving fluid out of the exhaust port 16 or compressing air within the cylinder 14, depending on the mode of operation of the apparatus 10. Referring to FIG. 5E, in instances where the apparatus 10 is operating as a compressor, the piston 12*a* may be moved toward the proximal end 18 to permit the compressed gas to flow out of the exhaust port 16. In both compressors and pumps, the pistons 12*a*, 12*b* are driven back to the positions shown in FIG. 5A in preparation for the next iteration of the process.

Figure 6:
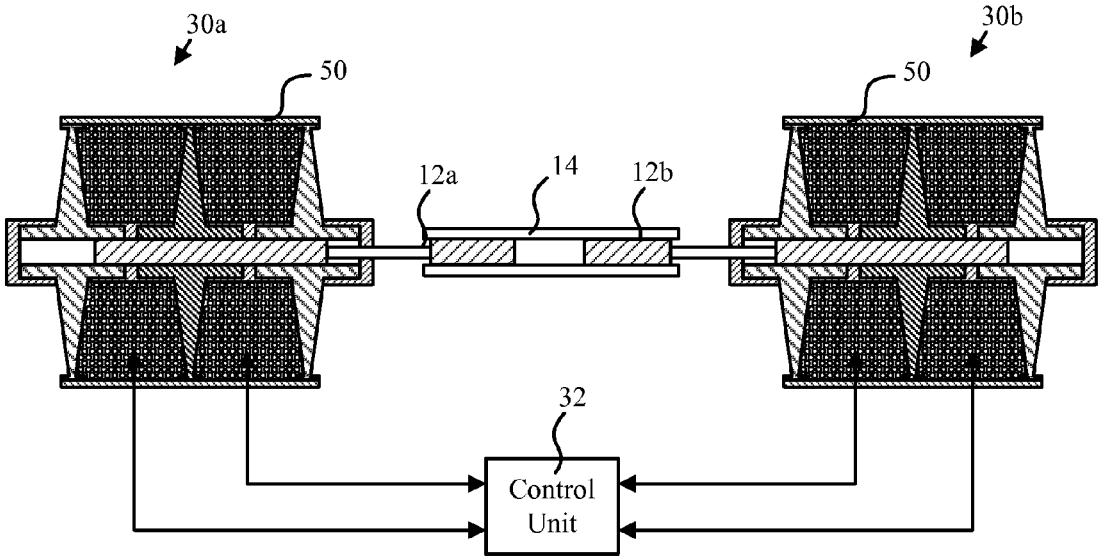
FIG. 6 is a side cross-section view of a linear engine coupled with two linear switched reluctance motors, in accordance with the present invention.
Figure 7:
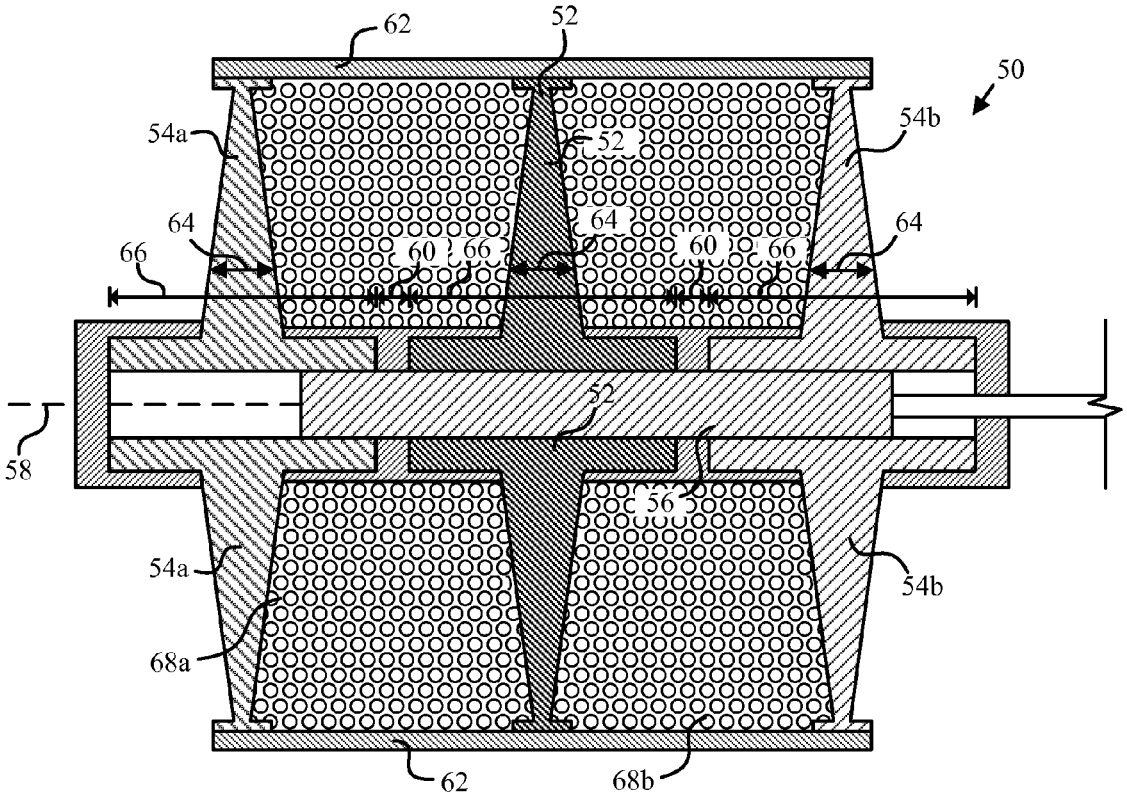
FIG. 7 is a side cross-section view of a linear switched reluctance motor, in accordance with the present invention.

Referring to FIGS. 6 and 7, each actuator/generator 30*a*, 30*b* may be embodied as a linear switched reluctance motor 50. The motor 50 of FIG. 7 serves as the actuator/generator 30*a*. The depicted actuator/generator 30*b* is embodied as the mirror image of the actuator/generator 30*b*. Each motor 50 may include an optional flux source 52, flanked on either side by two alternate flux paths 54*a*, 54*b*. The flux source 52 and alternate flux paths 54*a*, 54*b* may surround a flux modulating piston 56 which is movable to close a magnetic circuit between one of the alternate flux paths and the flux source 52. In one embodiment, the flux source 52 is molded from a ferromagnetic material and radially magnetized to provide a substantially constant source of flux.

The illustrated flux source 52 and alternate flux paths 54*a*, 54*b* are substantially symmetrical about a longitudinal axis 58 of the flux modulating piston 56. The flux source 52 and alternate flux paths 54*a*, 54*b* may be spaced apart longitudinally along the flux modulating piston 56, with the flux source separated from each of the alternate flux paths 54*a*, 54*b* by a gap 60 filled with a nonferromagnetic material or simply air.

A flux bridge 62 may extend around the outer circumference of the flux source 52 and alternate flux paths 54*a*, 54*b*. The flux bridge 62 typically either contacts both the flux source 52 and alternate flux paths 54*a*, 54*b* or is attached thereto. The flux bridge 62 may be made of a magnetically permeable material to ensure that magnetic flux passes freely from the flux source 52 and the alternate flux paths 54*a*, 54*b*.

The radial cross section of the alternate flux paths 54*a*, 54*b* and flux source 52 may be chosen to ensure proper conduction of magnetic flux therealong. Inasmuch as the illustrated radial cross sections of the alternate flux paths 54*a*, 54*b* and flux source 52 are revolved around the longitudinal axis 58, the area through which magnetic flux must pass may be kept constant by narrowing the widths 64 thereof with distance from the longitudinal axis 58. Proximate the flux modulating piston 56, the alternate flux paths 54*a*, 54*b* and flux source 52 may have a widths 66 chosen to increase conduction of magnetic flux therefrom to the piston 56.

The piston 56 may be separated from alternate flux paths 54*a*, 54*b* and the flux source 52 by a small gap filled with air or lubricant to permit movement. Accordingly, increased widths 66 ensure flux conduction across the air gap substantially equal to the flux conduction of the alternate flux paths 54*a*, 54*b* and the flux source 52. Induction coils 68*a*, 68*b* may be positioned around each alternate flux paths 54*a*, 54*b*, respectively. In the illustrated embodiments current flows circumferentially within the coils around the longitudinal axis 58. The induction coils 68*a*, 68*b* may be electrically coupled to the control unit 32, which selectively permits current to flow through the coils 68*a*, 68*b* to accomplish the fluid handling processes discussed hereinabove.

The motor 50 may also function as a generator. When the piston 56 is compelled to move along its range of travel it modulates magnetic circuits between the flux source 52 and alternate flux paths 54*a*, 54*b*. As the circuits are modulated, the magnetic field incident on the coils 68*a*, 68*b* changes, generating an electric current in the coils 68*a*, 68*b*.

Figure 8A:
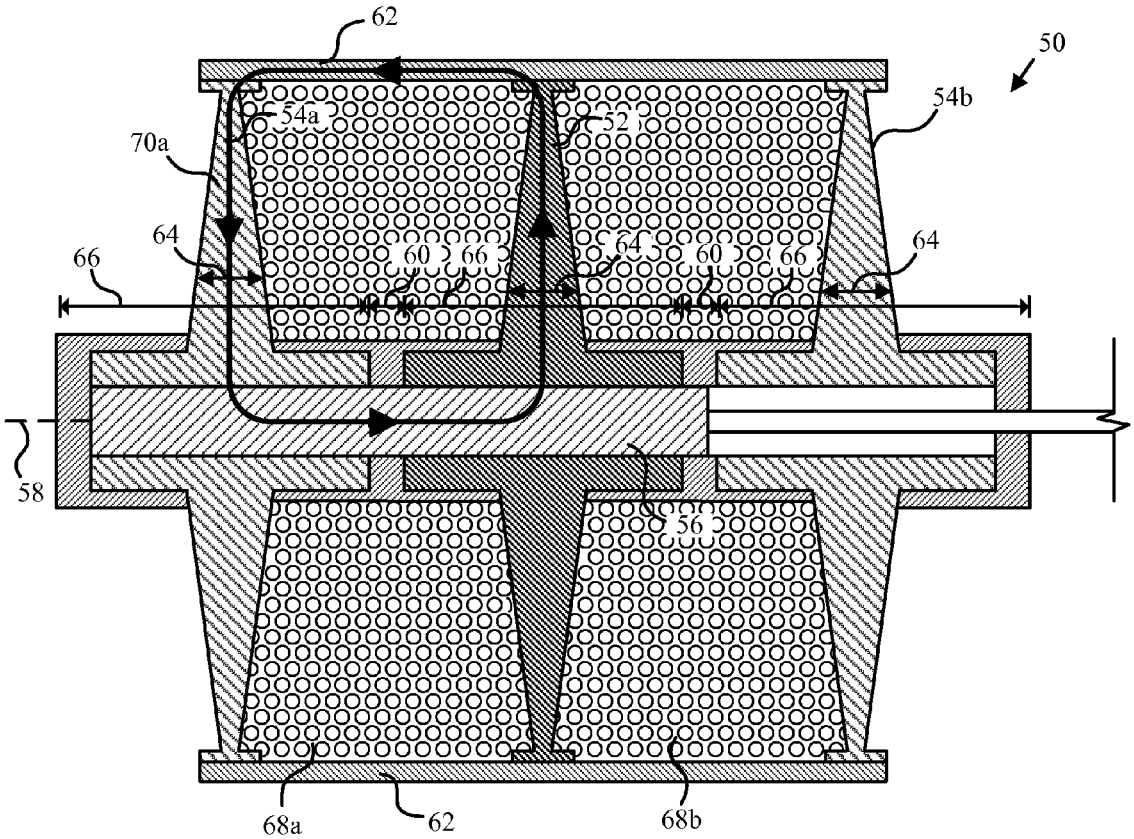
FIG. 8A-8C are side cross-section views of the motor of FIG. 6 illustrating the operations thereof, in accordance with the present invention.
Figure 8B:
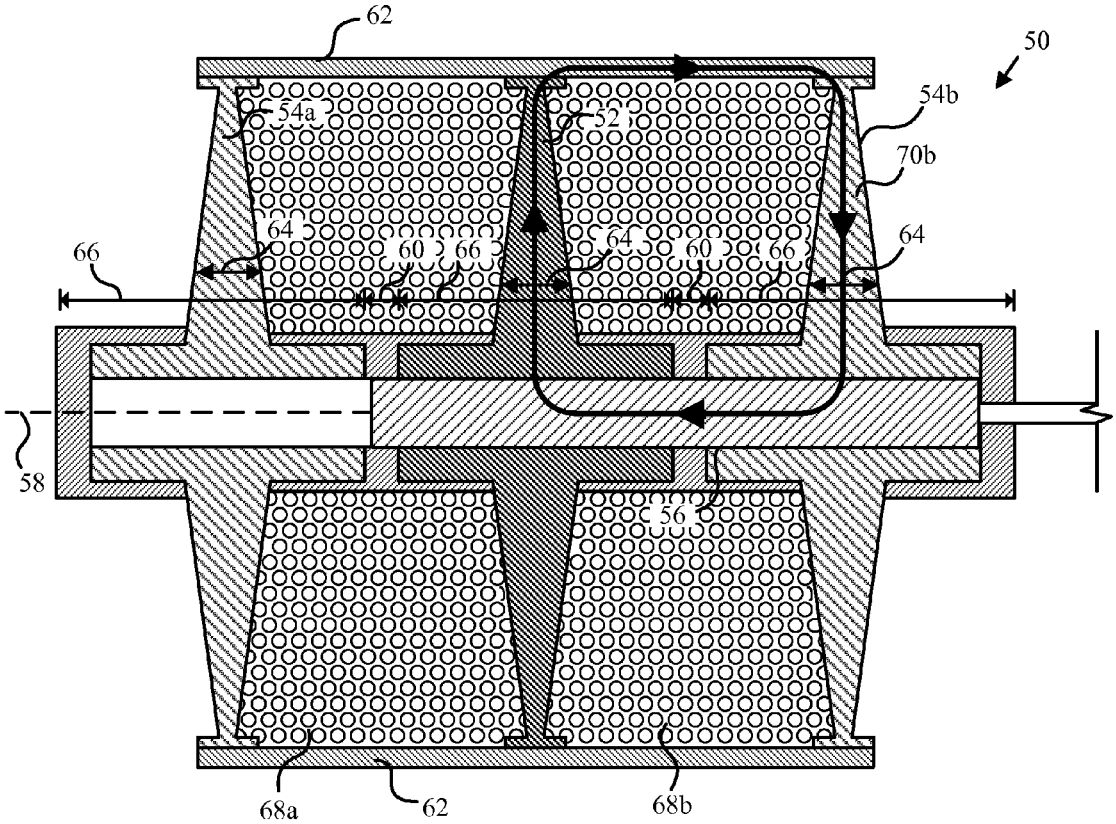
Figure 8C:
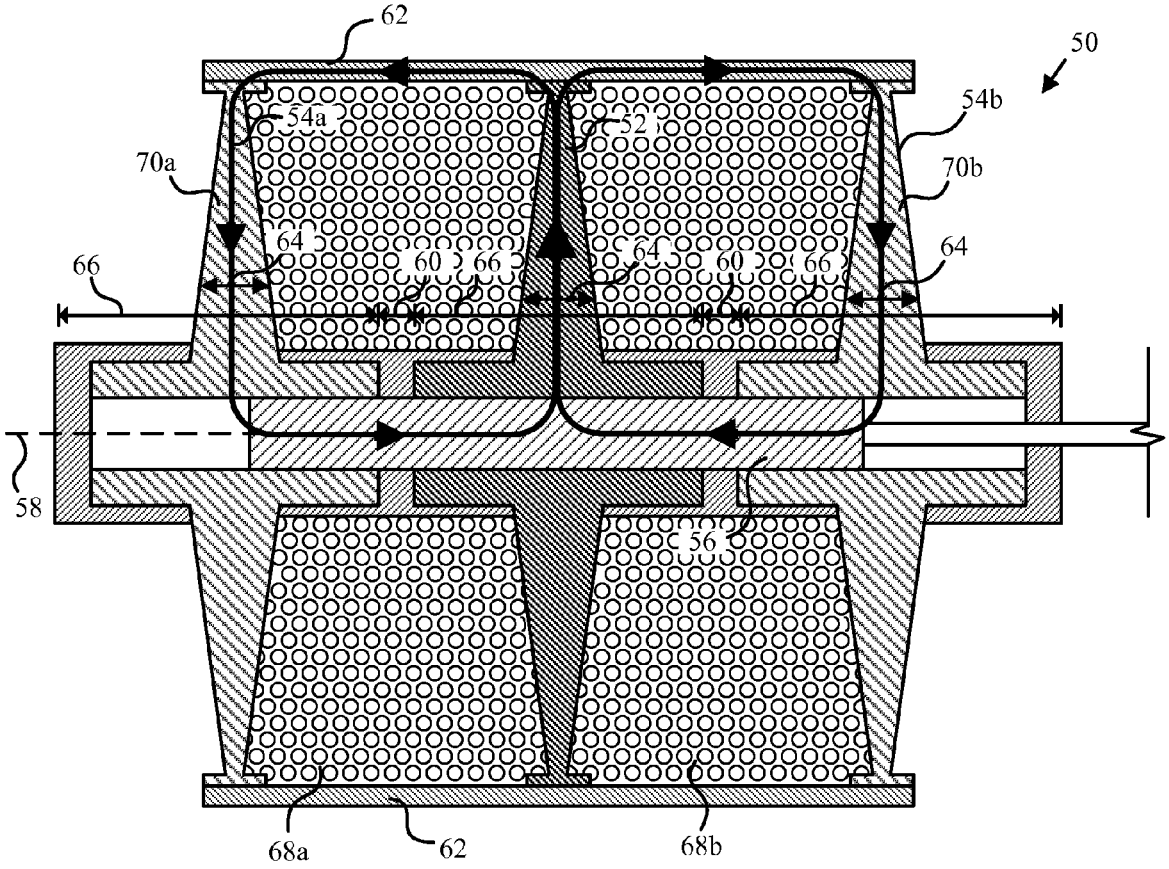

Referring to FIGS. 8A-8C, current may be provided to the coils 68*a*, 68*b* either one coil 68*a*, 68*b* at a time or both coils 68*a*, 68*b* together. Referring to FIG. 8A, as current flows through coil 68*a*, magnetic flux is induced in alternate flux path 54*a*, drawing the flux modulating piston 56 toward the alternate flux path 54*a* and completing a magnetic circuit 70*a* passing through the piston 56, alternate flux path 54*a*, flux bridge 62, and flux source 52. Referring to FIG. 8B, the coil 68*b* may be activated, drawing the flux modulating piston 56 toward the alternate flux path 54*b* and completing a magnetic circuit 70*b* passing through the piston 56, alternate flux path 54*b*, flux bridge 62, and flux source 52.

Referring to FIG. 8C, when a single coil 68*a*, 68*b* is activated, the flux modulating piston 56 will tend to maximize the flux flowing from itself to one of the alternate flux paths 54*a*, 54*b*. Accordingly, the piston will be compelled to move to maximize the overlap of the piston with one of the alternate flux paths 54*a*, 54*b*, depending on which coil 68*a*, 68*b* has been activated. At a certain point, the flux provided by the optional flux source 52 may be sufficient to drive the piston 56 toward a point of maximum overlap without providing current to the coils 68*a*, 68*b*. The piston 56 may consequently remain at or near the point of maximum overlap unless acted upon by other forces.

In some embodiments, the point of maximum overlap corresponds to the extreme ends of the range of travel of the piston 56. To achieve positions between the extreme ends of the range of travel of the piston 56, both coils 68*a*, 68*b* may be activated in equal or different degrees to cause the piston to move to a central position between the two alternate flux paths 54*a*, 54*b* or slightly offset therefrom.

Figure 9:
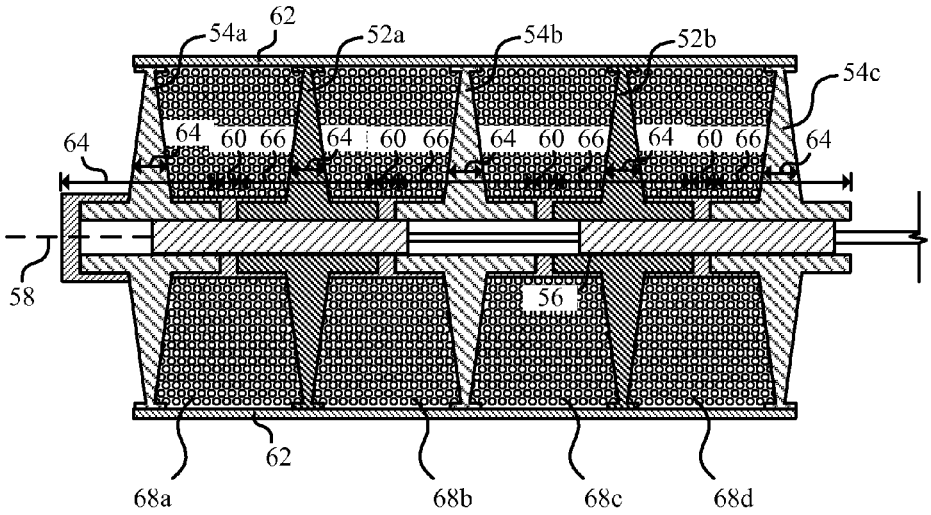
FIG. 9 is a side cross-section view of an alternative embodiment of a linear switched reluctance motor, in accordance with the present invention.
Figure 10:
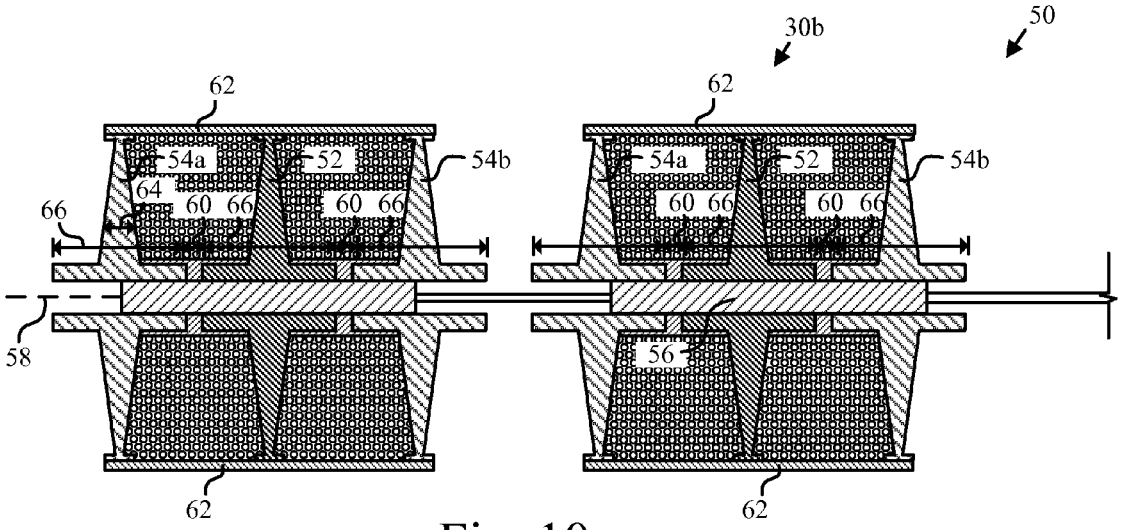
FIG. 10 is a side cross-section view of yet another embodiment of a linear switched reluctance motor, in accordance with the present invention.

Referring to FIG. 9, in some embodiments, a greater number of positions may be achieved by activation of a single coil 68*a*, 68*b* by providing an alternating series of alternating flux sources 52*a*, 52*b*, separated by alternate flux paths 54*a*-54*c* each with a corresponding coils 68*a*-68*d*. Referring to FIG. 10, alternatively, multiple single-coil activation positions may be achieved using multiple motors 50*a*, 50*b* having their pistons 56 coupled together. The motors 50*a*, 50*b* may be out of phase with one another, such that the single coil activation positions of the first motor 50*a* fall between the single coil activation positions of the second motor 50*b*.

Figure 11:
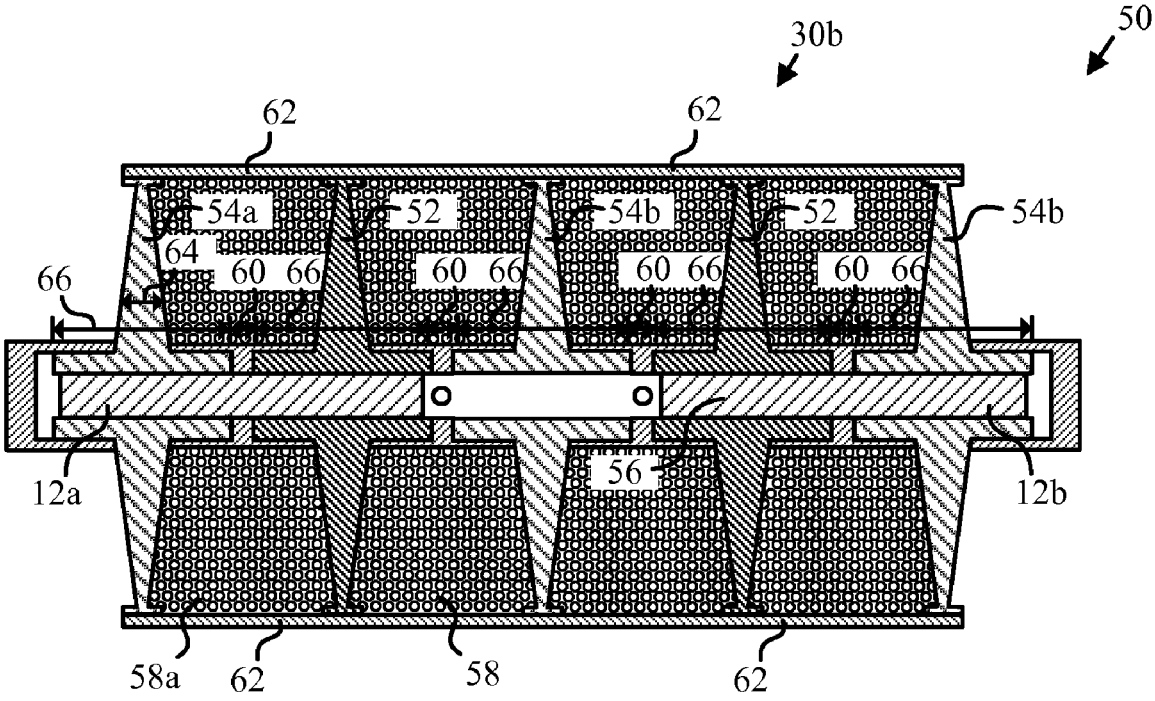
FIG. 11 is a side cross-section view of a linear switched-reluctance motor having integrated pistons, in accordance with the present invention.

Referring to FIG. 11, in some embodiments, the flux modulating piston 56 may be integrated with a piston 12*a*, 12*b*. For example, the motor 50 of FIG. 10 may be modified to include two flux modulating pistons 56*a*, 56*b* and have the exhaust port 16 and intake port 20 formed in the channel in which the pistons 56*a*, 56*b* travel. Accordingly, the flux modulating pistons 56*a*, 56*b* would execute the processes as described above for the pistons 12*a*, 12*b*, respectively.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A paired-piston machine comprising:

a cylinder defining an intake port toward a first end thereof and an exhaust port toward a second end thereof;

a first and a second piston disposed within the cylinder in a substantially co-linear horizontally-opposed configuration, the first and second piston capable of independent movement within the cylinder;

a control unit configured to induce a five-phase combustion process comprising an intake phase, a compression phase, a combustion phase, a first exhaust phase, and a recovery phase; and wherein the control unit is further configured to induce a cooling cycle comprising a fuel-less second intake phase and a second exhaust phase.

2. The paired-piston machine of claim 1, wherein the compression phase of the five-phase combustion process comprises substantially symmetric compression of the first and second piston toward a compression region disposed between the intake port and the exhaust port of the cylinder.

3. The paired-piston machine of claim 2, wherein the compression region is proximate a midpoint of the cylinder.

4. The paired-piston machine of claim 1, further comprising a first electric generator unit secured to the first piston and a second electric generator unit secured to the second piston.

5. The paired-piston machine of claim 4, wherein at least one generator unit of the first and second electric generators is a linear generator.

6. The paired-piston machine of claim 1, further comprising a fuel source in fluid communication with the cylinder.

7. The paired-piston machine of claim 1, wherein an expansion phase of the five-phase combustion process comprises substantially symmetric expansion toward the first and second end of the cylinder.

8. The paired-piston machine of claim 1, wherein an exhaust phase of the five-phase combustion process comprises moving the second piston past the exhaust port and moving the first piston toward the second piston.

9. The paired-piston machine of claim 1, wherein a recovery phase of the five-phase combustion process comprises moving the first and second piston toward the intake port.

10. The paired-piston machine of claim 1, wherein an intake phase of the five-phase combustion process comprises moving the first piston past the intake port and moving the second piston toward the exhaust port.

11. The paired-piston machine of claim 10, wherein the intake phase comprises drawing an air-fuel mixture into the cylinder.

12. The paired-piston machine of claim 1, wherein combustion phase comprises injection of fuel into the cylinder.

13. The paired-piston machine of claim 1, further comprising a fuel source in fluid communication with the cylinder and wherein the control unit is configured to cause the pistons to execute a two-stroke combustion process.

14. A paired-piston machine comprising:

a cylinder defining an intake port toward a first end thereof and an exhaust port toward a second end thereof;

a first and a second piston disposed within the cylinder in a substantially co-linear horizontally-opposed configuration;

a control unit configured to induce a five-phase combustion process comprising an intake phase, a compression phase, a combustion phase, a first exhaust phase, and a recovery phase; and wherein the first exhaust phase of the five-phase combustion process comprises moving the second piston past the exhaust port and moving the first piston toward the second piston.

15. A paired-piston machine comprising:

a cylinder defining an intake port toward a first end thereof and an exhaust port toward a second end thereof;

a first and a second piston disposed within the cylinder in a substantially co-linear horizontally-opposed configuration;

a control unit configured to induce a five-phase combustion process comprising an intake phase, a compression phase, a combustion phase, a first exhaust phase, and a recovery phase; and wherein the intake phase of the five-phase combustion process comprises moving the first piston past the intake port and moving the second piston toward the exhaust port.

* * * * *